United States Patent [19]

Carandang et al.

[11] 3,969,258

[45] July 13, 1976

[54] LOW FOAMING ACID-ANIONIC SURFACTANT SANITIZER COMPOSITIONS

[75] Inventors: Carmen Maneclang Carandang; George Roman Dychdala, both of Norristown, Pa.

[73] Assignee: Pennwalt Corporation, Philadelphia, Pa.

[22] Filed: Oct. 10, 1974

[21] Appl. No.: 513,544

[52] U.S. Cl. ..... 252/106; 252/136; 252/142

[51] Int. Cl.[2] ..... C11D 1/22; C11D 3/48

[58] Field of Search ..... 252/106, 107, 136, 142

[56] References Cited

UNITED STATES PATENTS

| | | | |
|---|---|---|---|
| 2,221,933 | 11/1940 | Eitelman et al. | 252/143 |
| 2,338,689 | 1/1944 | Parker et al. | 21/57 |
| 3,173,875 | 3/1965 | Wegst et al. | 252/105 |
| 3,218,260 | 11/1965 | Lewandowski | 252/142 |
| 3,525,696 | 8/1970 | Schmidt et al. | 252/106 |
| 3,529,015 | 9/1970 | Steinhauer et al. | 260/512 |
| 3,650,964 | 3/1972 | Sedliar et al. | 252/106 |
| 3,650,965 | 3/1972 | Cantor et al. | 252/106 |
| 3,793,221 | 2/1974 | Orthalek et al. | 252/136 |

FOREIGN PATENTS OR APPLICATIONS

| | | |
|---|---|---|
| 917,432 | 2/1963 | United Kingdom |

OTHER PUBLICATIONS

Sosis, Def. Pub. of Ser. No. 793,188, filed 1–22–69, Def. Pub. No. T862,020.

*Primary Examiner*—P.E. Willis, Jr.
*Attorney, Agent, or Firm*—Plumley and Tyner

[57] ABSTRACT

Low foaming acid sanitizer compositions containing anionic surfactants which normally exhibit high-foaming, e.g. dodecyl benzene sulfonic acid, are obtained by incorporating in the composition a foam suppressant combination of a $C_8$–$C_{18}$-aliphatic alcohol, or a $C_9$–$C_{12}$-alkyl-phenol, e.g. tridecyl alcohol and a polyvalent metal salt, e.g. aluminium sulfate. The usual solubilizers such as propylene glycol and isopropyl alcohol can be present as optional ingredients. Anti-microbial properties of the composition are not adversely affected by the foam suppressants and the compositions exhibit low foaming even in deionized water.

8 Claims, No Drawings

LOW FOAMING ACID-ANIONIC SURFACTANT SANITIZER COMPOSITIONS

A. BACKGROUND OF THE INVENTION

A variety of sanitizer compositions containing anionic surfactants and acid as the essential ingredients providing anti-microbial activity are known. While the known compositions meet or exceed accepted standards for anti-microbial activity, a common and troublesome deficiency of many of the known compositions is that they create undesirably high foam levels, especially when used in cleaning-in-place or spray applications. The problem is magnified by the use of treated or deionized water as a diluent before use because treated or deionized water results in higher foaming than hard water. Since sanitizer compositions are typically supplied as concentrates for subsequent dilution by the user, it is desirable that the use composition have low foaming characteristics whatever the nature of the diluent water chosen by the user.

It is recognized that the foaming problem is caused by the anionic surfactant but the problem is not easily resolved because anionic surfactants such as linear alkyl aryl sulfonic acids are desirable for their recognized anti-microbial function activity and because such known anionic surfactants are considered attractive for their good anti-microbial activity and low cost. One common solution to the foaming problem is to add silicone foam reducing agents but silicones are undesirable in food and milk plant sanitizer compositions because the silicones tend to build up on equipment and harbor bacteria.

One solution to the foaming problem is to substitute the commonly used high foaming surfactants such as linear alkyl aryl sulfonic acids with anionic surfactants which are low foaming in the acid sanitizer environment as disclosed in U.S. Pat. No. 3,650,934. In this invention, the alternative of incorporating a foam suppressant into the composition whereby the advantages of common and widely available anionic surfactants are obtained with the elimination or reduction of the high foaming problem.

B. SUMMARY OF THE INVENTION

In its broadest aspect, this invention relates to low foaming sanitizer compositions based on acid and anionic surfactants utilizing a normally high foaming anionic surfactant in combination with a foam suppressant. The foam suppressant comprises a mixture of a $C_8$–$C_{18}$-aliphatic alcohol and/or a $C_9$–$C_{12}$-alkyl-phenol and a polyvalent metal compound.

More specifically, this invention relates to a sanitizer composition comprising a mixture of the following essential ingredients:

a. anionic surfactant;
b. acid;
c. $C_8$–$C_{18}$-aliphatic alcohol or a $C_9$–$C_{12}$-alkyl substituted phenol or a mixture thereof and
d. polyvalent metal compound.

It has been determined that the inclusion of the foam suppressant combination comprising $C_8$–$C_{18}$-alcohol and/or a $C_9$–$C_{12}$-alkyl-phenol and polyvalent metal compound results in a sanitizer composition which can be diluted with water for use and which results in a composition having low foaming characteristics without detrimental loss of the necessary anti-microbial activity. Even when diluted with treated or deionized water in the necessary proportions, the compositions of this invention exhibit low foaming and anti-microbial activity which surpasses the recommendations and requirements of the United States Public Health Service, the USDA and the Environmental Protection Agency (EPA).

Just as the corresponding compositions of the prior art, the compositions of this invention are typically provided in concentrated form containing the above-mentioned essential ingredients. Water and other ingredients which do not adversely affect the low foaming and anti-microbial characteristics of the composition, can also be present in the concentrate. Indeed, some water is advantageously present in the concentrated form of the inventive compositions, as are certain solubilizing agents discussed below. As already indicated, the concentrates are intended for dilution with water before use. The degree of dilution, depends on the strength of the concentrate but the concentrate is normally formulated so that a dilution of one ounce of the concentrate with about two or three gallons of water will give a use solution having the necessary anti-microbial characteristics. Generally, water is added to the concentrate to provide a use solution having a pH of 3.5 or less, preferably 1.8–2.5 and most preferably about 2, and sufficient to meet the anti-microbial standards.

A method of determining anti-microbial activity accepted by the USDA and the EPA is the Germicidal and Detergent Sanitizers Test, Methods of Analysis, Association of Official Analytical Chemists, 11th Edition (1970) pp. 66–68. In this test, the effective kill of the use solution is measured on specified test organisms (*Escherichia coli* and *Staphylococcus aureus*). Under the standards recommended by the U.S. Public Health Service, according to the grade A Pasteurized Milk Ordinance, 1965 Recommendations of the U.S. Public Health Service Appendix F, pp. 131, is "Bactericides, which, in recommended concentrations, produce a 99.999 % kill of 75–125 million *Escherichia coli* ATCC 11229 and 75–125 million of *Staphylococcus aureus* ATCC 6538 within 30 seconds at 70°–75°F. should be satisfactory". Accordingly, the use concentration is calculated to meet these recommended requirements. In general, the dilution ratio necessary to exceed the described standards will result in a use solution containing the essential ingredients in the following concentrations in parts/million:

a. anionic surfactant - 50 to 1000 p.p.m.;
b. acid - 200 to 2000 p.p.m.;
c. aliphatic alcohol and/or alkyl phenol-50 to 500 p.p.m.; and
d. polyvalent metal compound — 10 to 400 p.p.m.

The anionic surfactants which can be used in preparing the compositions of this invention, in general, are any of the anionic compounds which have anti-microbial activity, particularly in strongly acid media. The anionic surfactant component can comprise a single anionic surfactant or a mixture thereof. In particular, the anionic surfactant or mixture of anionic surfactants contains at least one anionic surfactant which has desirable anti-microbial characteristics but which exhibits undesirably higher foaming characteristics. Specifically, such high foaming surfactants include dodecyl benzene sulfonic and tridecyl benzene sulfonic acid. Mixtures thereof with alkyl-phenoxy benzene disulfonic acid, alkenyl-phenoxy benzene disulfonic acid, naphthalene sulfonic acid, alkyl-naphthalene sulfonic acid, or alkenyl-naphthalene sulfonic acid, are also contemplated.

The anionic surfactant can be introduced into the composition in the acid form or in the salt form, particularly as the sodium salt.

Especially advantageous results have been obtained with compositions which comprise at least one high foaming anionic surfactant with at least one member from each of the following three groups:

Group 1 — $C_1$–$C_{18}$-alkyl-benzene sulfonic acid such as dodecyl benzene sulfonic acid, tridecyl benzene sulfonic acid and xylene sulfonic acid;

Group 2 — alkyl-phenoxy benzene disulfonic acid or alkenyl-phenoxy benzene disulfonic acid; especially where the alkyl- and alkenyl-groups are $C_8$–$C_{16}$;

Group 3 — naphthalene sulfonic acid, alkyl-naphthalene sulfonic acid, or alkenyl-naphthalene sulfonic acid, especially where the alkyl- or akenyl- groups have relatively short chain lengths, of $C_8$ or below, preferably $C_1$–$C_4$.

Other anionic surfactants as well as non-ionic surfactants can be present such as those disclosed in U.S. Pat. No. 3,650,964, which is incorporated herein by reference for a listing of such anionic and non-ionic surfactants.

The acid or mixture of acids to be used in this invention is not highly critical except that the acid must be capable of producing a pH of 3.5 or less in the use concentration in order to obtain optimum antimicrobial effects. Suitable acids include phosphoric acid, hydrochloric acid, hydroxy acetic acid, sulfuric acid, diglycolic acid, lactic acid, acetic acid, sulfamic acid and the like. Weaker acids such as gluconic acids and citric acid can also be used, normally in combination with a stronger acid in order to achieve the minimum pH of 3.5. Phosphoric acid is preferred because of its behaviorial characteristics and the relatively low cost of food grade phosphoric acid.

The $C_8$–$C_{18}$-aliphatic alcohol and/or $C_9$–$C_{12}$-alkylphenol component of the composition which, in conjunction with the polyvalent metal compound acts as a foam suppressant, can be selected from a wide variety of such defined aliphatic alcohols and alkyl-phenols. Preferably, the aliphatic alcohol has the formula R—OH in which R is $C_8$–$C_{18}$-alkyl or $C_8$–$C_{18}$-alkenyl. Also, it is preferred that the alkyl and alkenyl groups in the alcohol and the alkyl groups in the phenol have straight chain.

The polyvalent metal compound can be any of a variety of polyvalent metal salts, oxides or hydroxides. Preferably, the polyvalent metal compound is a compound of a trivalent metal. Compounds of divalent and trivalent iron and aluminum have been found to be suitable. Examples of suitable compounds are ferric ammonium sulfate, aluminum sulfate, aluminum hydroxide and ferrous sulfate.

Solubilizing agents can also be present in the compositions of this invention. Solubilizing agents include those materials which serve to increase the solubility of the various organic components of the composition in water. The solubilizing agents therefore, are used to assist in making stable and compatible compositions which do not physically separate in the concentrated state and which form clear and stable solutions in the dilute state. Ideally, the solubilizing agents increase the shelf life stability of the concentrate over a wide temperature range and do not adversely affect the antimicrobial and low-foaming characteristics of the composition. Among the suitable solubilizing agents which can be mentioned are the aliphatic mono- and polyhydroxy alcohols such as ethanol, propanol, isopropanol, butanol, ethylene glycol, propylene glycol, glycerol, and the like.

C. SPECIFIC EMBODIMENT OF THE INVENTION

The invention is illustrated by the examples summarized in Table I in which all components are indicated in percent by weight.

TABLE I

| Ingredients | 1 | 2 | 3 | 4 | 5 | 6 | 7 | 8 | 9 | 10 |
|---|---|---|---|---|---|---|---|---|---|---|
| Dodecyl benzene sulfonic acid | — | 5 | 5 | 5 | — | 5 | 5 | — | 5 | 5 |
| Tridecyl benzene sulfonic acid | 5 | — | — | — | — | — | — | — | — | — |
| Petro ULF | 10 | — | — | — | 5 | 10 | 10 | 10 | 10 | 10 |
| Dowfax 3B2 | 10 | 10 | 10 | 10 | 10 | 10 | 10 | 10 | 10 | 10 |
| Alkanol BG | — | 10 | — | — | — | — | — | — | — | — |
| Lomar NCO | — | — | 5 | — | — | — | — | — | — | — |
| Nopcosant | — | — | — | 5 | — | — | — | — | — | — |
| Xylene sulfonic acid | — | — | — | — | 10 | — | — | — | — | — |
| Phosphoric Acid (75%) | 50 | 50 | 50 | 50 | 50 | 50 | 50 | 50 | 50 | 50 |
| Tridecyl Alcohol | 7 | 7 | 7 | 7 | 7 | 7 | 7 | — | — | — |
| Dodecyl Phenol | — | — | — | — | — | — | — | 5 | — | 7 |
| Nonyl Phenol | — | — | — | — | — | — | — | — | 7 | — |
| Aluminum Sulfate | 1 | 1 | 1 | 1 | 1 | 1 | — | 1 | 1 | 1 |
| Ferric Ammonium Sulfate | — | — | — | — | — | — | 1 | — | — | — |
| Propylene Glycol | 8 | 8 | 8 | 8 | 8 | 8 | 8 | 8 | 8 | 8 |
| Isopropyl Alcohol | 2 | 2 | 2 | 2 | 2 | 2 | 2 | 2 | 2 | 2 |
| Water | 7 | 7 | 12 | 12 | 7 | 7 | 7 | 14 | 7 | 7 |

In the foregoing compositions, the tradenamed materials are chemically identified as follows:

Petro ULF — Linear alkyl naphthalene sulfonate (50% solution)

Dowfax 3B2 — Sodium n-decyl diphenyl ether disulfonate (45% solution) (biodegradeable)

Alkanol BG — Sodium alkyl naphthalene sulfonate (40%)

Lomar NCO — Sodium salt of condensed naphthalene sulfonic acid (90%)

Nopcasant — Sulfonated naphthalene. (95%)

The concentrated compositions of Examples 1–10 above were diluted with water to a typical use concentration by mixing one ounce of the concentrate with 2 gallons of deionized water. Germicidal and foaming tests were conducted on the use solutions, the results of which are tabulated in Table II below.

The germicidal tests were conducted in accordance with the method described in the Germicidal and Detergent Sanitizers Test which is more specifically identified above. An entry of "Pass" indicates that a 99.999 percent kill rate of the particular organism was achieved in 30 seconds at 70°–75°F. An entry of "Delay" indicates tht a kill rate of 99.999 percent was achieved in the longer period of time indicated in parenthesis (either 60 or 120 seconds).

The foam test was conducted by placing a 250 ml. sample of the sanitizer in the use concentration at room temperature (about 75°F) in a graduated 500 ml. glass cylinder with a stopper, vigorously inverting the stoppered cylinder 15 times and then recording the foam volume by subtracting the liquid volume from the total volume in the cylinder after a period of time which is indicated.

TABLE II

| Test | 1 | 2 | 3 | 4 | 5 | 6 | 7 | 8 | 9 | 10 |
|---|---|---|---|---|---|---|---|---|---|---|
| *Escherichia coli* kill | Pass | Pass | Pass | Pass | Pass | Pass | Pass | Pass | Pass | Pass |
| *Staphylococcus aureus* kill | Delay (60 sec) | Pass | Pass | Pass | Delay (60 sec.) | Pass | Pass | Delay (120 sec.) | Pass | Delay (120 sec.) |
| Deionized Water Initial Foam (ml) | 150 | 125 | 120 | 100 | 150 | 175 | 150 | 80 | 50 | 50 |
| Room Temperature Final Foam (ml) | 30 | 25 | 20 | 5 | 5 | 10 | 15 | 0 | 5 | 3 |
| Time | 2M | 40S | 40S | 40S | 30S | 1.5M | 2M | 10S | 40S | 30S |

We claim:

1. The anti-microbial sanitizer composition consisting essentially of a mixture, based on 100 parts by weight thereof, of:

5 to 25 parts of a. anti-microbial anionic surfactant or a mixture of anti-microbial anionic surfactants including a normally high foaming anionic surfactant, selected from the group consisting of $C_1$–$C_{18}$-alkylbenzene sulfonic acid, salts thereof and mixtures of said acid or salts with an alkyl- or alkenylphenoxy benzene disulfonic acid, naphthalene sulfonic acid, alkyl- or alkenyl-naphthalene sulfonic acid;

30 to 50 parts of b. an acid selected from the group consisting of phosphoric acid, hydrochloric acid, hydroxyacetic acid, sulfuric acid, diglycolic acid, lactic acid, acetic acid and sulfamic acid;

2 to 15 parts of c. a $C_8$–$C_{18}$-aliphatic alcohol, a $C_9$–$C_{12}$-alkylphenol or mixture thereof; and 0.5 to 10 parts of d. a trivalent compound of iron and aluminum selected from the group consisting of ferrous aluminum sulfate, aluminum sulfate and aluminum hydroxide;

said components (c) and (d) being compatible in said composition and present in amounts sufficient to reduce foam formation in said composition compared to the foam formation which occurs in the absence of said (c) and (d) components.

2. The anti-microbial composition of claim 1 in which said trivalent compound of aluminum or iron (d) is ferrous aluminum sulfate.

3. The anti-microbial composition of claim 1 in which said trivalent compound of aluminum or iron is aluminum sulfate.

4. The anti-microbial sanitizer composition of claim 1 in which said acid (b) is phosphoric acid.

5. The anti-microbial sanitizer composition of claim 1 in which said $C_8$–$C_{18}$-aliphatic alcohol (c) has the formula R—OH in which R is $C_8$–$C_{18}$-alkyl or $C_8$–$C_{18}$-alkenyl.

6. The anti-microbial sanitizer composition of claim 1 in which said $C_8$–$C_{18}$-aliphatic alcohol (c) has the formula R—OH in which R is $C_8$–$C_{18}$-alkyl.

7. The anti-microbial sanitizer composition of claim 1 which consists essentially of a mixture based on 100 parts by weight thereof, of:

a. 5 to 25 parts by weight of the acid or sodium salt of a $C_1$–$C_{18}$-benzene sulfonic acid or mixtures thereof with alkyl- or alkenyl-phenoxy benzene disulfonic acid, naphthalene sulfonic acid, or alkyl- or alkenyl-naphthalene sulfonic acid;

b. 30 to 50 parts of phosporic acid;

c. 2 to 15 parts of an aliphatic alcohol having the formula R-OH in which R is $C_8$–$C_{18}$-alkyl or $C_8$–$C_{18}$-alkenyl;

d. 0.5 to 10 parts of said trivalent aluminum or iron compound; and e. 0 to 72.5 parts of water.

8. The anti-microbial sanitizer composition of claim 7 in which the anionic surfactant (a) comprises a mixture of 1. the acid or sodium salt of dodecyl benzene sulfonic acid or tridecyl benzene sulfonic acid;
2. the acid or sodium salt of alkyl- or alkenyl-phenoxy benzene disulfonic acid; and
3. the acid or sodium salt of naphthalene sulfonic acid, or alkyl- or alkenyl-napthalene sulfonic acid.

* * * * *

UNITED STATES PATENT OFFICE

CERTIFICATE OF CORRECTION

Patent No. 3,969,258 Dated July 13, 1976

Inventor(s) Carmen M. Carandang/George R. Dychdala

It is certified that error appears in the above-identified patent and that said Letters Patent are hereby corrected as shown below:

Column 5, line 56, claim 1, "ferrous" should read --ferric--.

Column 6, line 6, claim 2, "ferrous" should read --ferric--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*